US005412406A

United States Patent [19]

Fujimoto

[11] Patent Number: 5,412,406

[45] Date of Patent: May 2, 1995

[54] LINE HEAD DRIVING WITH BATCH-PRINTING

[75] Inventor: Hisayoshi Fujimoto, Kyoto, Japan

[73] Assignee: Rohm Co., Ltd., Kyoto, Japan

[21] Appl. No.: 21,973

[22] Filed: Feb. 24, 1993

[30] Foreign Application Priority Data

Feb. 24, 1992 [JP] Japan ..... 4-036238

[51] Int. Cl.[6] ..... B41J 2/355

[52] U.S. Cl. ..... 347/180; 347/12; 347/13

[58] Field of Search ..... 346/76 PH; 400/120; 358/296; 347/12, 13

[56] References Cited

U.S. PATENT DOCUMENTS

| | | | |
|---|---|---|---|
| 4,638,329 | 1/1987 | Nakayama et al. | 346/76 PH |
| 4,738,553 | 4/1988 | Uemura et al. | 346/76 PH |
| 5,014,135 | 5/1991 | Ijuin et al. | 346/76 PH |
| 5,072,237 | 12/1991 | Takaoka | 346/76 PH |

*Primary Examiner*—Huan H. Tran

*Attorney, Agent, or Firm*—Dickstein, Shapiro & Morin

[57] ABSTRACT

A thermal head has a reduced power capacity and an electronic apparatus incorporates that thermal head. Printing data is stored in a shift register while ON-data for one line is latched relative to each block in a heating element array. A microcomputer checks the magnitude of the number of ON-data in each block. If the number of ON-data is equal to or less than a given value, the microcomputer outputs a strobe signal to that block so that the heating elements therein will be batch-driven. If the number of ON-data exceeds the given level, the microcomputer outputs two or more strobe signals to that block which in turn is further divided into two blocks. The two or more divided blocks are sequentially driven. In order to change the batch-printing range depending on the printing rate, the power capacity can be reduced to the minimum level within the necessary limit.

8 Claims, 5 Drawing Sheets

LINE HEAD DRIVING WITH BATCH-PRINTING

BACKGROUND OF THE INVENTION

1. Field of the Invention

The present invention relates to a thermal head and an electronic apparatus incorporating the thermal head, such as a facsimile machine, printer, plotter, word processor or the like.

2. Description of the Related Art

A thermal head is generally known which comprises a head or drive substrate, a plurality of heating elements disposed on the substrate in longitudinal and transverse lines, a drive element on the substrate for energizing the heating elements, a shift register on the substrate for receiving and storing data to be printed, and a plurality of integrated driving circuits (drive IC) on the substrate, these drive IC's including various circuits such as a latch circuit for holding the data to be printed stored in the shift register to provide them to the drive element. In the thermal head of such a type, the number of heating elements is very large (e.g. 2048). Thus, the heating elements are separately driven by using a plurality of strobe signals to actuate the drive element in a time shared manner for every block of strobe signals. Thus, the maximum current passing through the thermal head is equal to a current flowing through the total dots (heating elements) in one strobe which is divided by the strobe signal.

Electronic apparatus using the thermal head, such as facsimile machines, are desired to be reduced in size and cost as they are becoming more widespread. Therefore, the thermal heads are also required to be reduced in power and size.

As described, the maximum current passing through the prior art thermal head depends on the current flowing through the total number of dots in one strobe. Therefore, the time normally required to make the printing cannot be prolonged beyond a given length, resulting in the maximum current which cannot be reduced below a given level. On the other hand, if the printing rate is lower and the number of dots to be energized is smaller, the current decreases to provide a sufficient margin in power capacity. This provides a large difference in power between the higher and lower printing rates. In other words, the maximum current passing through the prior art thermal head depends on the total number of dots capable of being energized in one strobe. Thus, the prior art thermal head requires a power capacity meeting the maximum current. As a result, the size, weight and cost of power source could not be reduced below a certain level.

SUMMARY OF THE INVENTION

It is therefore an object of the present invention to provide a thermal head which can be used with a power source having a reduced power capacity and which can reduce the size, weight and cost of the power source and to provide an electronic apparatus incorporating such a thermal head.

To this end, the present invention provides a thermal head comprising an array of heating elements, memory means for storing inputted printing data, means for computing the printing rate in the inputted printing data, batch-printing range determining means responsive to the computed printing rate for determining the range of heating elements used in a batch printing operation, and means for driving the heating elements in accordance with the printing data stored in the printing data storing means and the batch-printing range determined by the batch-printing range determining means.

DETAILED DESCRIPTION OF THE PREFERRED EMBODIMENTS

Figure 1:
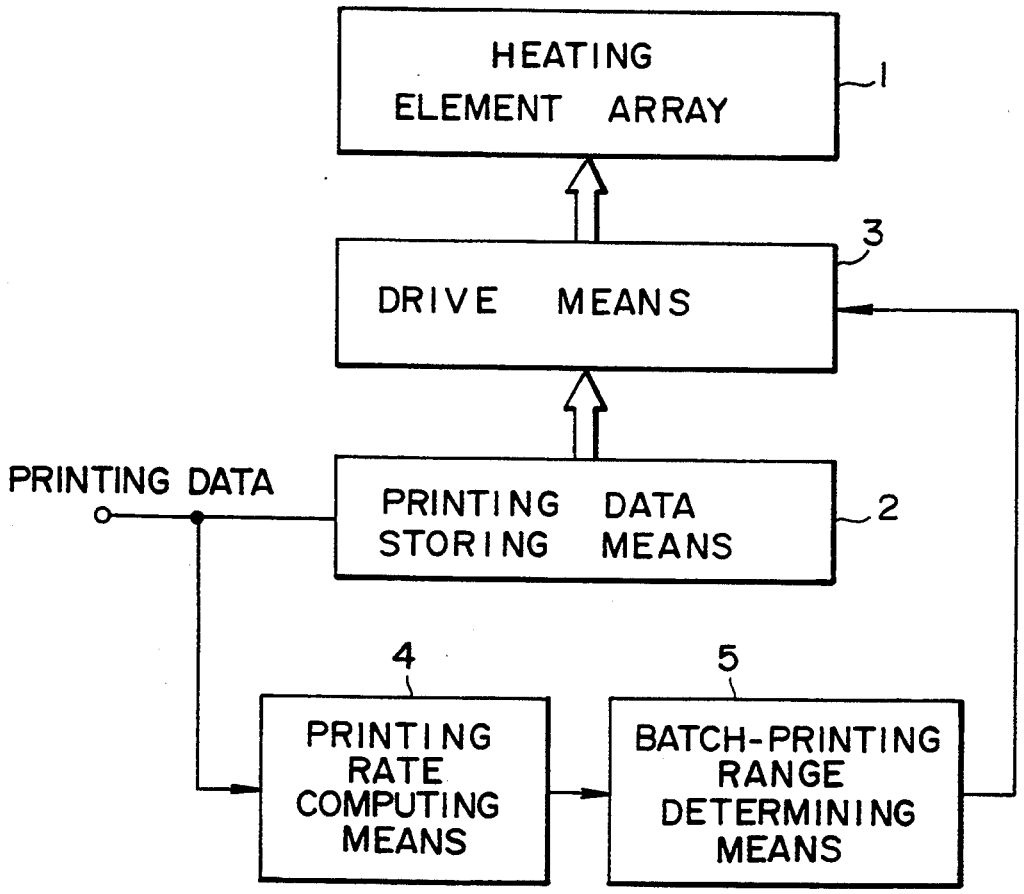
FIG. 1 is a block diagram of a thermal head constructed in accordance with the present invention.

Referring to FIG. 1, there is shown a thermal head constructed in accordance with the present invention, which comprises a heating element array 1 including heating elements equal in number to N, the heating elements being arranged on a substrate; printing data storing means 2 for storing printing data inputted sequentially bit by bit; drive means 3 for driving the respective heating elements in the array 1 in accordance with the printing data stored in the printing data storing means 2; printing rate computing means 4 for computing the printing rate of the inputted printing data; and batch-printing range determining means 5 for determining the range of heating elements to be printed in the batch in accordance with the computed printing rate, whereby the drive means can be actuated to divide the heating elements into blocks in accordance with batch-printing ranges and the heating elements in each of the divided blocks can be used simultaneously on printing.

In the thermal head, the inputted printing data is stored in the printing data storing means 2 and at the same time used to compute the printing rate in the printing rate computing means 4. The printing rate is the percentage of bits to be printed which are present in the printing data within a given range. The batch-printing range determining means 5 determines a batch-printing range depending on the computed printing rate. When the printing rate is smaller, the batch-printing range is determined to be larger. In the large batch-printing range, the drive means 3 is simultaneously actuated to divide the heating element array 1 into the reduced number of blocks which in turn are driven by the drive means. On the contrary, if the printing rate is higher, the batch-printing range is reduced and the drive means 3 is actuated within the reduced batch-printing range to divide the heating element array 1 into the increased number of blocks.

Figure 2:
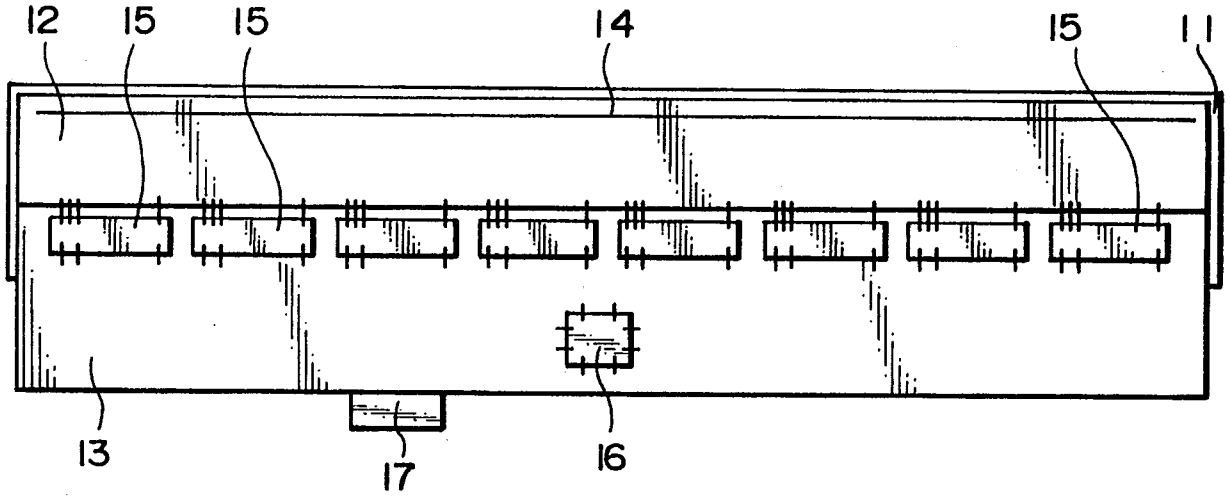
FIG. 2 is a schematic plan view of one embodiment of a thermal head constructed in accordance with the present invention.

FIG. 2 shows the details of one embodiment of a thermal head constructed in accordance with the present invention. The thermal head comprises a heat radiating plate 11 and head and drive substrates 12, 13, both of which are placed on the heat radiating plate 11. The head substrate 12 has its end edge on which a heating element array 14 including heating elements of 2048 in number is arrange in a line. The drive substrate 13 includes eight drive IC's 15 and a control LSI chip 16, all of which are mounted on the drive substrate 13. The drive substrate 13 also includes an external connector 17. In the illustrated thermal head, all the components other than the control LSI chip 16 are known in the art. It is to be understood that the heating element array 14 is electrically connected to the respective drive IC's 15, control LSI chip 16 and external connector 17 through known wiring patterns (not shown).

Figure 3:
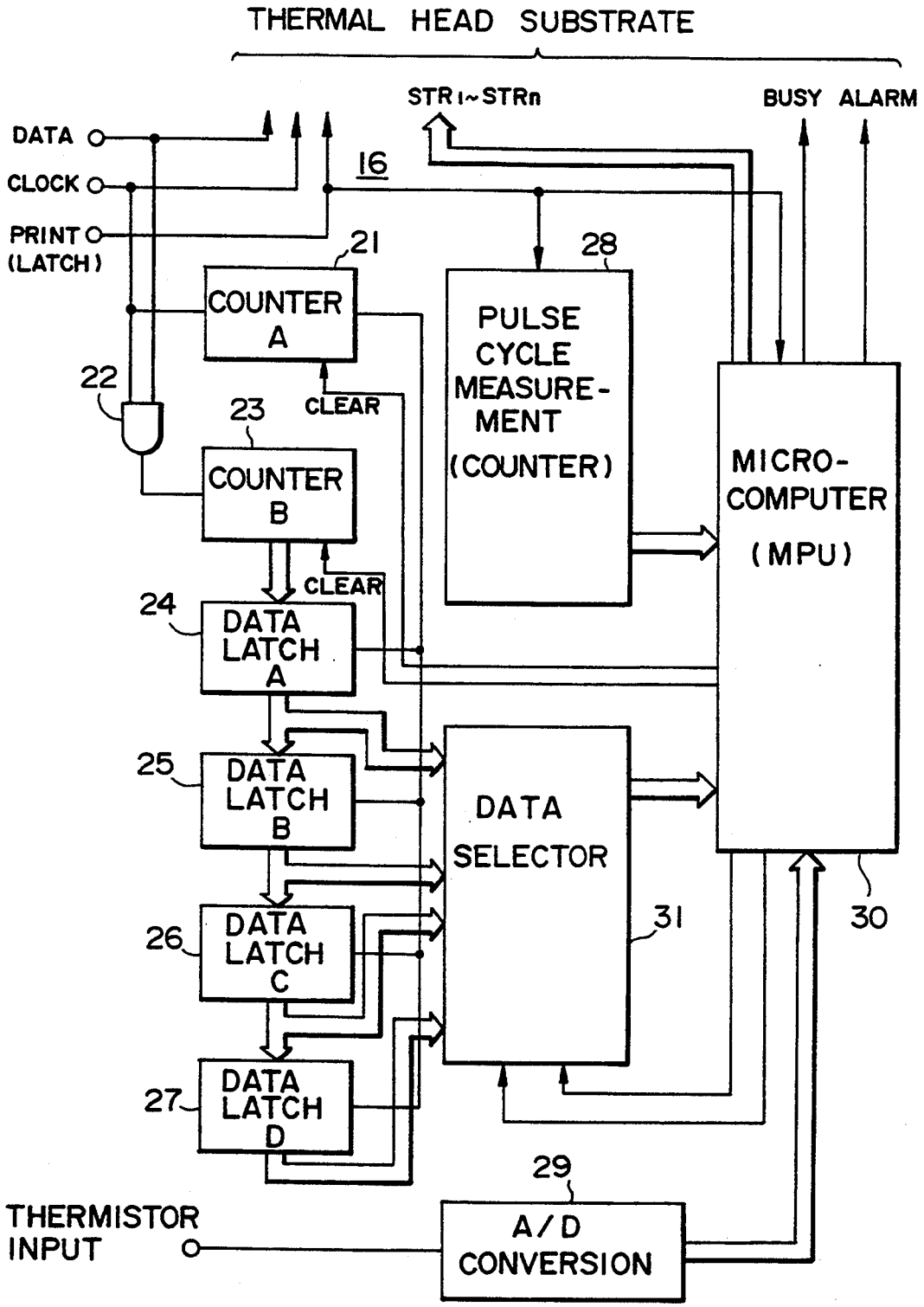
FIG. 3 is a block diagram illustrating the internal circuit in the control LSI used in the thermal head of FIG. 2.

FIG. 3 is a block diagram illustrating the internal circuitry in the control LSI chip 16. The control LSI chip 16 comprises a counter A 21 for receiving and counting clock signals CLOCK; an AND circuit 22 for receiving data signals DATA in addition to the clock signals CLOCK; another counter B 23 for counting the outputs of the AND circuit 22, that is, ON-data in the printing data; data latch circuits 24, 25, 26 and 27 for temporarily latching the number of ON-data; a pulse cycle measurement circuit (counter) 28 for measuring the cycle of the printing pulse; an A/D conversion circuit 29 for converting signals from a thermistor (heat sensing element) into digital signals; a microcomputer (MPU) 30 for executing control functions; a data selector 31 for providing the latched data in the data latch circuits 24, 25, 26, and 27 to the MPU 30.

The control functions of the MPU 30 include a first function for performing the measurement of the number of data and for making the determination and execution of the number of driven strobes (STR) in accordance with the measurement; a second function for performing the determination and execution of the driving time period in the strobe signals from the printing cycle and A/D converted data in the thermistor; a third function for outputting a BUSY signal indicative of the printing apparatus being used; and a fourth function for outputting an ALARM signal when the temperature of the thermal head exceeds the upper limit of the permissible temperature range or falls below the lower limit thereof.

In the illustrated thermal head, the number of strobes (STR) to be divided is increased more than the normal. More particularly, the number of strobe signals $STR_1$ to $STR_n$ is determined to be $n=8$ maximum. Since the number of dots in the heating element array 14 is determined to be equal to 2048 , the thermal head will be controlled so that the number of dots simultaneously energized becomes equal to a maximum of 256.

When the printing data DATA is inputted into the illustrated thermal head, it is stored in the shift registers of the drive IC's 15 and at the same time applied to the AND circuit 22. Further, a clock signal CLOCK for shifting the printing data DATA by one bit is added to the counter A 21 and to the AND circuit 22. The counter A 21 counts clock signals CLOCK added thereto while the AND circuit 22 outputs ON-data signals in synchronism with the clock signals CLOCK, and these ON-data signals are counted by the counter B 23. The counter A 21 is constructed to perform a counting-up step after it has counted the number of clocks corresponding to the number of dots obtained when the heating element array 14 is divided substantially into four blocks. When the number of clock signals CLOCK corresponding to the first block of the four-divided heating element blocks is counted by the counter A 21, the counter B 23 counts the number of ON-data in the first block.

When the counter A 21 counts up, its count-up signal triggers the data latch circuits A 24, B 25, C 26 and D 27, the data latch circuit A 24 latching the ON-data count in the counter B 23. Subsequently, the counter B 23 similarly counts ON-data for the second block of the four divided blocks. When the counter A 21 again counts up, the data latch circuits A 24 to D 27 are again triggered and the data latch circuit A 24 transfers its latched data to the data latch circuit B 25 and also latches the count in the counter B 23. As such counting-up steps are repeated four times in the counter A 21, each of the data latch circuits A 24 to D 27 will store the number of ON-data for one line relative to the respective one of the four divided blocks.

When the ON-data for one line is latched relative to each block, the data is taken by the MPU 30 through the data selector 31. The MPU 30 then checks the magnitude of the number of ON-data for each block. For example, if the ON-data in each of the blocks is less than 256 dots, the printing can be carried out in four or less blocks. If it is assumed that strobe signals are $STR_1$ to $STR_4$ and that drive elements corresponding to the respective blocks are put together into a lump, the latter may be added in a time shared manner to the strobes $STR_1$ to $STR_4$. If the ON-data in any one of the four blocks exceeds 256 dots, only that block is divided into two. Thus, the printing steps for five divided blocks will be carried out.

On the contrary, if the number of ON-data in all the four blocks or for one line is less than 256 dots, the printing step may be carried out only for a single block.

The time required to energize each of the heating elements is determined by the printing cycle (SLT) and the thermal head temperature. The MPU 30 includes a memory table for storing the energizing period using the printing cycle and temperature as addresses. When the pulse cycle measuring circuit 28 receives a printing command PRINT to measure the printing cycle and also receives a temperature signal from the thermistor through the A/D converter 27, the optimum energizing period is read out from the memory table. The MPU 30 then outputs a strobe signal having its width corresponding to the optimum energizing period. More particularly, the memory table may store energizing periods corresponding to temperatures which are respectively required, for example, when the printing cycle SLT is less than 4 msec., when the printing cycle SLT is ranged between 4 msec. and 7 msec. and when the printing cycle is larger than 7 msec..

During the actual printing operaton, the MPU 30 outputs a BUSY signal because it must be externally informed when the time for which the thermal head is being operated is changed due to changes in the printing cycle and temperature. When the temperature changes out of the upper or lower limit, the MPU 30 outputs an ALARM signal which can be used to prevent the printing from being improperly performed and to protect the apparatus.

It is believed that a general written document has a printing rate equal to about 10%. In the illustrated embodiment, the ON-data is equal to 205 dots for the total 2048 dots. This may be batch-printed. Thus, the printing speed can be further increased.

The number of heating elements, blocks, drive IC's or other components may be suitably selected depending on the intended application within the technical concept of the present invention.

Figure 4:
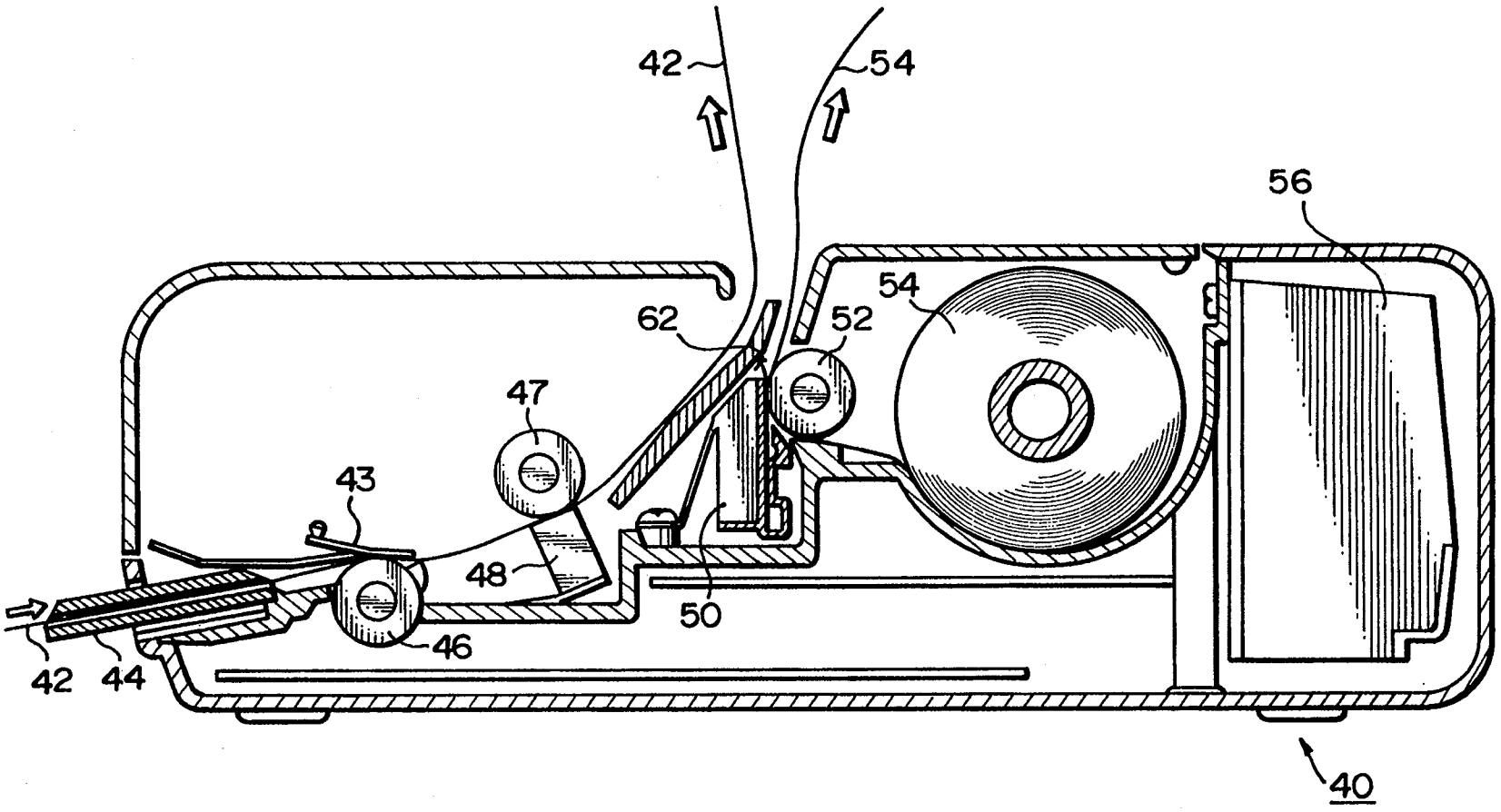
FIG. 4 is a schematic cross-section of a printing apparatus including a thermal head constructed in accordance with the present invention.

Referring next to FIG. 4, there is shown an electronic apparatus such as a printing apparatus which incorporates a thermal head constructed in accordance with the present invention. The printing apparatus 40 comprises an inlet port 44 into which documents 42 are to be inserted; a feed roller 46 for feeding the documents; an image sensor 48 for reading the contents of the document; a printing section 50 for printing onto a recording sheet 54; and a recording platen roller 52 located adjacent to the printing section 50. The printing apparatus is powered by a power source 56. If a plurality of documents 42 are inserted into the apparatus through the inlet port 44, the documents 42 will be fed one at a time to the image sensor after separated by separation means 43. The pattern on the surface of the fed document 42 is converted into electrical signals at the image sensor 48. The electrical signals will be used to print the recording sheet 54 at the printing section 50. In order to be capable of printing onto rough sheets of paper, the apparatus uses an ink ribbon 62. It is to be understood that the thermal head used in this printing apparatus may be applied to copying machines and facsimile machines, each of which includes a reading mechanism.

Figure 5:
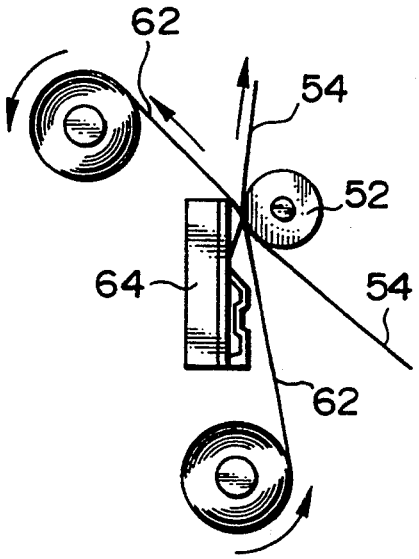
FIG. 5 is an enlarged and schematic view of the primary part of the printing apparatus shown in FIG. 4.

FIG. 5 is an enlarged view of the primary parts in the printing apparatus shown in FIG. 4, in which the platen roller 52 is formed of rubber and co-operates with a stationary thermal head 64 to feed the recording medium. The thermal head of the present invention may use a ribbon cassette (not shown) so that the thermal head 64 can be used in any serial printer in which the thermal head can move on a flat platen plate (not shown).

In accordance with the present invention, the power capacity may be reduced to the minimum level within the necessary limit since the range of batch-printing can be changed depending on the printing rate. Therefore, the size and weight of the power source can be reduced, resulting in a reduction of the entire apparatus size and a reduced cost.

I claim:

1. A thermal head comprising:

(a) an array of heating elements, (b) printing data storing means for storing inputted printing data, (c) means for computing a printing rate for the inputted printing data, (d) batch-printing range determining means responsive to the computed printing rate for determining a range of heating elements used in a batch printing, and (e) drive means for driving the heating elements in accordance with the printing data stored in said printing data storing means and the batch-printing range determined by said batch-printing range determining means.

2. A thermal head as defined in claim 1 wherein said drive means includes a microcomputer for outputting strobe signals corresponding in number to said batch-printing range.

3. A thermal head as defined in claim 2, wherein said array of heating elements is divided into a plurality of blocks and wherein said microcomputer outputs a strobe signal to a block in which said printing rate is equal to or less than a given level, said strobe signal batch-driving the heating elements in that block, and said microcomputer sequentially outputting two or more strobe signals to another block in which said printing rate exceeds said given level, said two or more strobe signals being used to divide the heating elements in said another block further into two or more blocks and to batch-drive the heating elements in the two or more further divided blocks sequentially.

4. A thermal head as defined in claim 1, further comprising temperature sensing means for sensing a temperature of the thermal head and means responsive to the sensed temperature or controlling a driven time period of each of the heating elements driven by said drive means.

5. A thermal head as defined in claim 4, further comprising means for measuring a printing cycle and means responsive to the measured printing cycle and the sensed temperature for controlling the driven time period of each of the heating elements driven by said drive means.

6. A printing apparatus comprising:

(a) input means for inputting printing data into said printing apparatus;

(b) a thermal head for printing a recording sheet in accordance with said printing data; and (c) means for supplying an electric power to said thermal head, and said thermal head comprising:

an array of heating elements, printing data storing means for storing inputted printing data, means for computing a printing rate for the inputted printing data, batch-printing range determining means responsive to the computed printing rate for determining the range of heating elements used in a batch printing, and drive means for driving the heating elements in accordance with the printing data stored in said memory means and the batch-printing range determined by said batch-printing range determining means.

7. A thermal head as defined in claim 6, further comprising temperature sensing means for sensing a temperature of the thermal head and means responsive to the sensed temperature for controlling a driven time period of each of the heating elements driven by said drive means.

8. A thermal head as defined as claim 7, further comprising means for measuring a printing cycle and means responsive to the measured printing cycle and the sensed temperature for controlling the driven time period of each of the heating elements driven by said drive means.

* * * * *